US006439906B1

(12) United States Patent
Gray et al.

(10) Patent No.: US 6,439,906 B1
(45) Date of Patent: Aug. 27, 2002

(54) COAX SWITCH ASSEMBLY

(75) Inventors: Ian James Stafford Gray, Winchester; Derek Andrews; Peter Jordan, both of Basingstoke, all of (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/531,275

(22) Filed: Mar. 20, 2000

(30) Foreign Application Priority Data

Mar. 25, 1999 (GB) ..... 9906991
Aug. 20, 1999 (EP) ..... 99306596

(51) Int. Cl.[7] ..... H01R 29/00; H01R 9/05; H01R 24/04

(52) U.S. Cl. ..... 439/188; 439/578; 439/668

(58) Field of Search ..... 439/188, 63, 944, 439/578, 877, 909, 581, 668

(56) References Cited

U.S. PATENT DOCUMENTS 4,561,716 A * 12/1985 Acke ..... 339/177
4,591,732 A * 5/1986 Neuenschwander ..... 307/140
5,074,809 A * 12/1991 Rousseau ..... 439/675
5,421,189 A 6/1995 Dussault ..... 73/19.1
5,466,160 A * 11/1995 Ogura ..... 439/63
5,563,562 A * 10/1996 Szwec ..... 333/260
5,692,926 A * 12/1997 Jarl ..... 439/668
5,703,324 A * 12/1997 Harder ..... 174/21
5,882,233 A * 3/1999 Idehara ..... 439/877
5,890,913 A * 4/1999 Kyllonen ..... 439/63
5,989,046 A * 11/1999 Togashi ..... 439/188
6,074,217 A * 6/2000 Maruyama et al. ..... 439/63
6,099,334 A * 8/2000 Togashi ..... 439/188
6,106,314 A * 8/2000 McLean et al. ..... 439/188
6,217,382 B1 * 4/2001 Ziers ..... 439/578

FOREIGN PATENT DOCUMENTS

GB 2 307 113 A 11/1995

* cited by examiner

*Primary Examiner*—P. Austin Bradley
*Assistant Examiner*—Edwin A. León
(74) *Attorney, Agent, or Firm*—Roger C. Turner

(57) ABSTRACT

A switch assembly is provided for mounting on a circuit board and for receiving a coax connector plug that opens the switch and connects the central coax plug element to one of the switch contacts, which enables the use of a plug (100) without a long projecting center contact element (102) and which enables many degrees of misalignment between the plug and switch. The switch (10) includes a housing (11) with an exposed upper face (22) having an entrance (24) for receiving the connector plug. First and second contacts (12, 14) are mounted on the housing, with the first contact including a resilient beam (18) biased up against the second contact but deflectable downwardly out of engagement with the second contact. An electrically conductive projection (19) projects upward at least partially through an opening (26) at the bottom entrance, so the center contact element of the plug does not have to project deeply through the opening in order to operate the switch and electrically connect to the beam. The entrance is tapered and has electrically conductive entrance walls. The outer element (106) of the connector plug preferably has a largely spherical front end, to make contact with the entrance tapered surface along a circular band (130) when fully pushed down into the entrance, despite many degrees (A) of misalignment of the axis (122) of the entrance with the axis (110) of the plug.

18 Claims, 4 Drawing Sheets

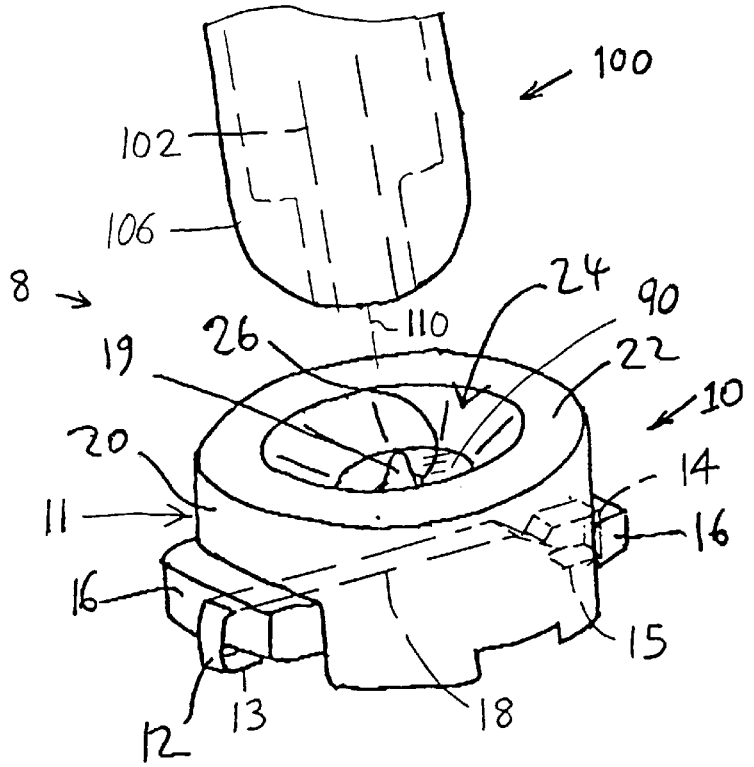
FIG. 1
FIG 2
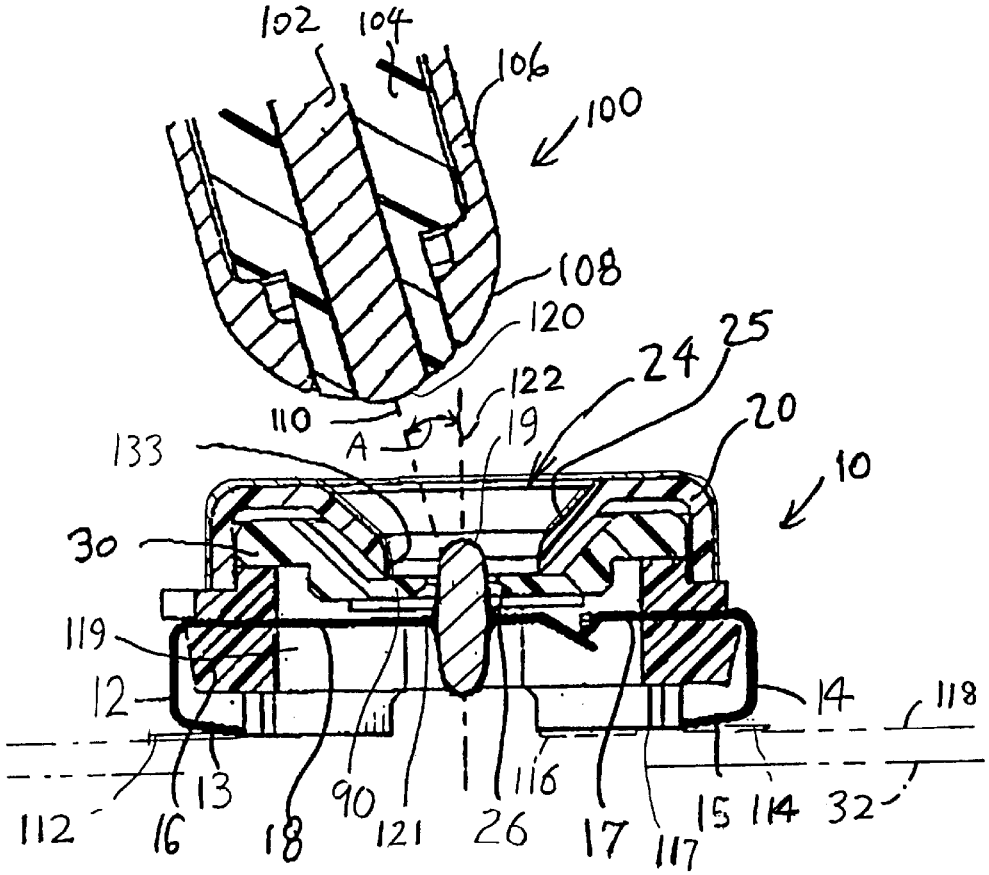

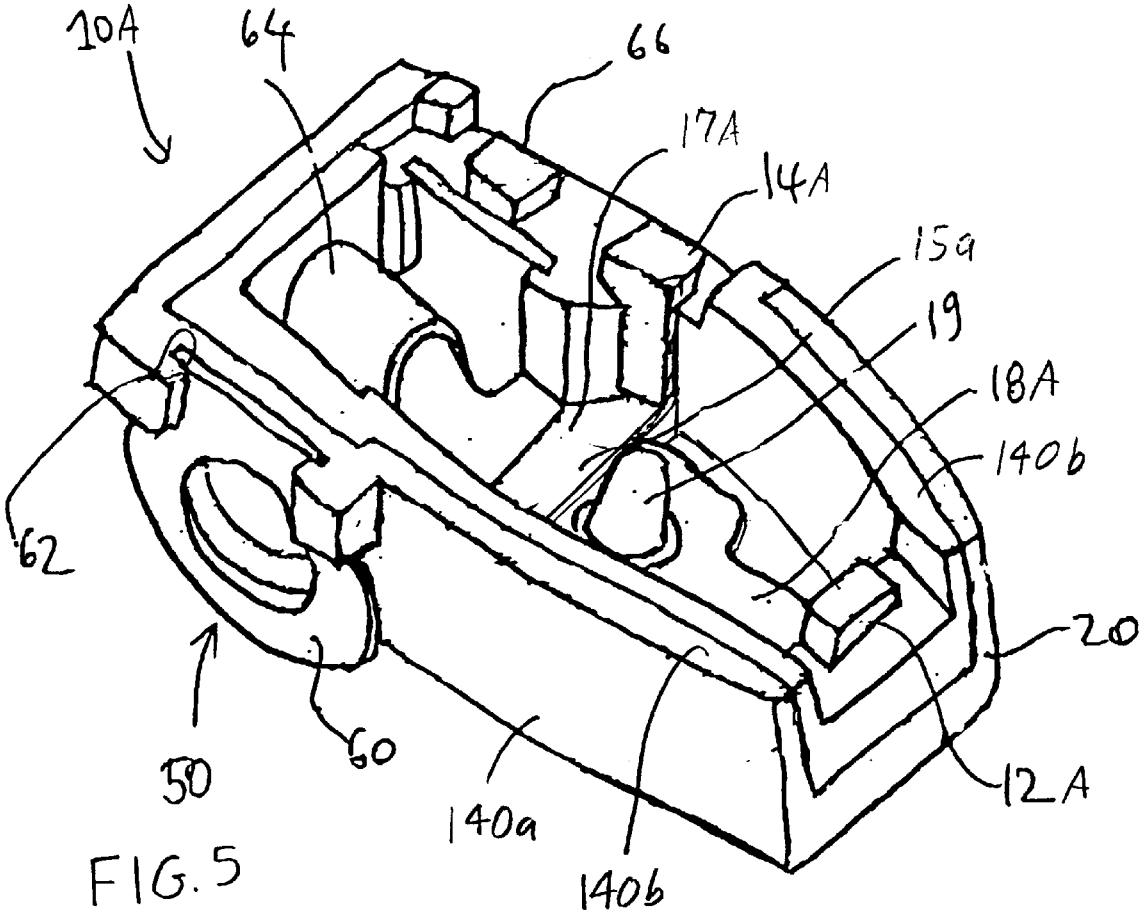
FIG. 5
FIG. 7
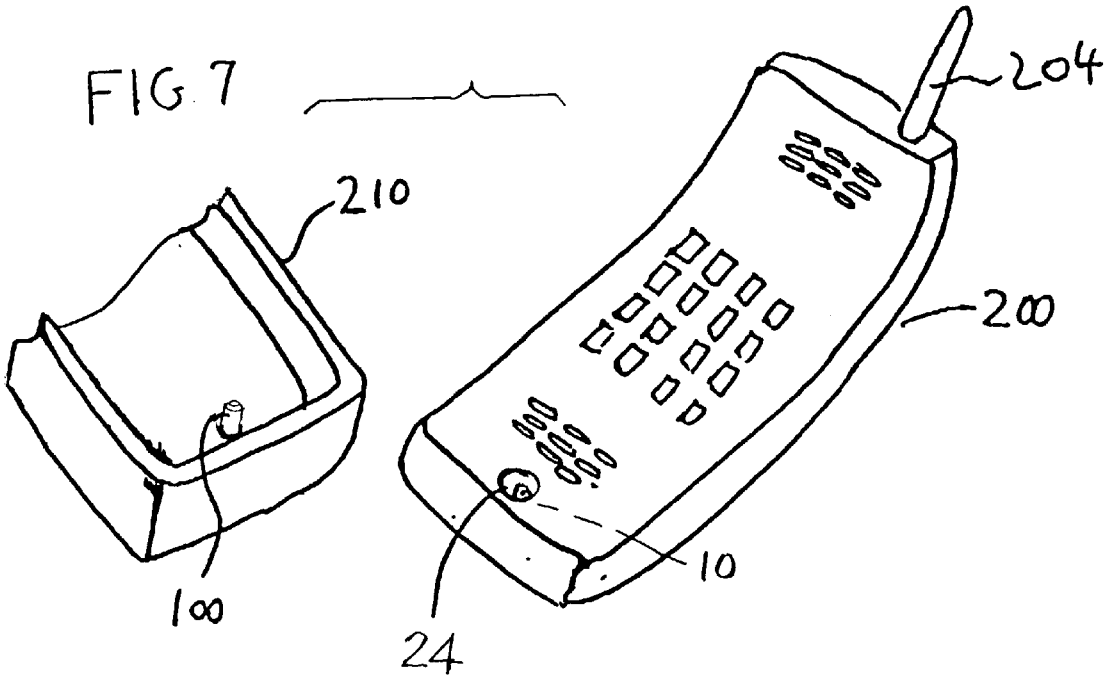

COAX SWITCH ASSEMBLY

CROSS-REFERENCE

Applicant claims priority from U.K. patent application 9906991.6 filed Mar. 25, 1999.

BACKGROUND OF THE INVENTION

One type of coaxial switch assembly includes a switch with a pair of contacts, with one contact having a resilient beam portion that can be depressed out of engagement with the other contact. The contact element of a connector plug can be pressed down against the beam to deflect it out of engagement with the second contact while establishing electrical connection with the beam and therefore with the first contact. The switch generally has a housing with an entrance into which the connector plug is inserted. For a coaxial switch and plug, the entrance area is electrically conductive to electrically engage the outer contact element of the plug while the inner contact element deflects and engages the beam.

The center contact element of the plug often must project considerably down through an opening to downwardly deflect the beam, resulting in a plug with a long thin center contact element that is subject to damage. A switch assembly that avoided the need for such a protruding long and thin contact element, would avoid damage to such contact element.

When a coax plug is inserted into a coax switch, with the outer contact element of the plug engaging conductive walls of the entrance of the switch, previous systems require accurate alignment of the axis of the plug with the axis of the switch entrance. It would be desirable if good connection between the outer plug contact and the walls of the switch entrance could be established when the plug is pushed down to a final position, despite many degrees of misalignment of the plug with the switch.

SUMMARY OF THE INVENTION

In accordance with one embodiment of the present invention, a switch assembly is provided which enables a plug with a conductive plug element to open a switch by deflecting a beam, without requiring a long thin projecting plug element, and for use with a coaxial connector plug without requiring close alignment of the axis of the plug with that of switch. An upward projection on the resilient beam, projects at least partially through an opening of the switch, so the plug element can depress the projection and therefore not have to extend through and far below the opening to directly engage the beam.

The switch has walls forming a tapered entrance leading to the opening, to guide the plug into position. The walls of the entrance are electrically conductive to engage an outer coaxial contact element of the plug. This occurs while the inner coaxial contact element electrically connects to the beam through the projection, which is conductive. The front end of the outer coaxial element is of largely spherical shape, to provide a ring-shaped contact area despite many degrees of misalignment of the axis of the plug with the axis of the entrance.

The novel features of the invention are set forth with particularity in the appended claims. The invention will be best understood from the following description when read in conjunction with the accompanying drawings.

BRIEF DESCRIPTION OF THE DRAWINGS

FIG. 1 is an exploded isometric view of a switch assembly, showing the entire switch and showing a portion of the connector plug.

FIG. 2 is a sectional view of the switch and a portion of the connector plug of FIG. 1.

FIG. 5 is a bottom isometric view of the switch of FIG. 4.

FIG. 7 is an exploded view of a mobile telephone and docking station which uses a switch assembly of the invention.

DESCRIPTION OF THE PREFERRED EMBODIMENTS

Figure 3:
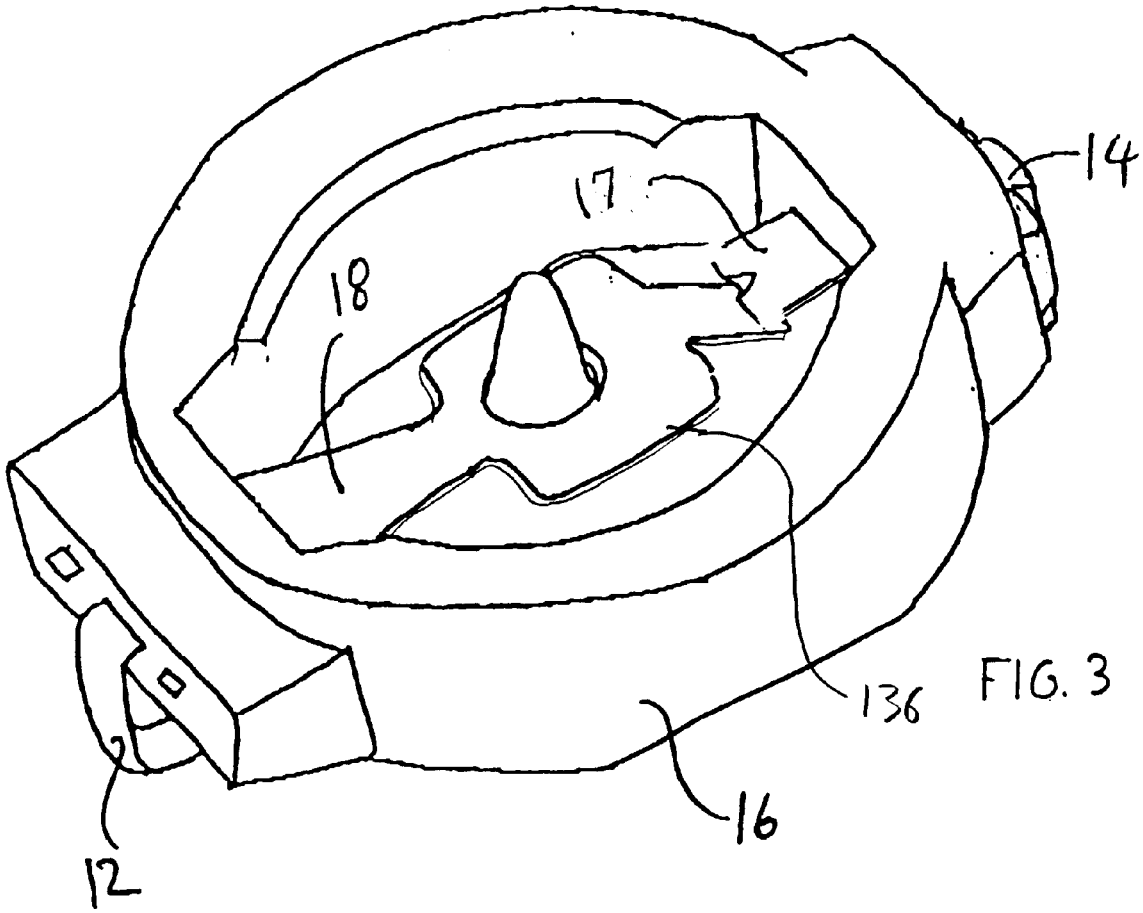
FIG. 3 is an isometric view of a portion of the switch of FIGS. 1 and 2.

FIG. 1 illustrates a switch assembly 8 which includes a switch 10 for mounting on a circuit board and a connector plug 100 for use with the switch. The connector plug is a coaxial plug, with inner and outer coaxial contact elements 102, 104 concentric with a plug axis 110. The switch 10 includes a housing 11 with upper and lower housing parts 20, 16. First and second contacts 12, 14 are mounted on the lower housing part 16. A resilient beam 18 of the first contact extends to the second contact, the beam preferably being part of the first contact 12. An upper face 22 of the housing has a receiving region, or entrance 24 which leads to a barrier 90 with an opening 26. The beam 18 lies below the opening 26. When the plug 100 is pressed down into the entrance 24, it depresses the resilient beam 18 to disengage it from the second contact 14 so as to open the switch by breaking connection between the first and second contacts. At the same time, electrical connection is made between the inner contact element 102 of the plug and the first contact 12 through the beam. FIG. 2 shows the switch 10 mounted on a circuit board 32 that has conductive traces 112, 114, 116 on its upper face 118. The contacts have tails 13, 15 that are positioned to lie against two of the traces on the circuit board, with solder joints or conductive cement usually used to permanently connect the contact tails to the circuit board traces.

In accordance with one aspect of the invention, applicant provides a projection 19, which is coupled to a location 121 on the beam 18, with both being part of the first contact. The projection projects upwardly from the beam by a vertical distance that is a plurality of times the thickness of the beam. The projection preferably extends at least partially through the opening 26 in the entrance side walls 25 at the bottom of the entrance 24. As a result, the lower or front end 120 of the plug inner element 102, does not require a long thin projection to project down through the opening 26 and against the beam 18, to open the switch and firmly engage the beam. Each of the contacts 12, 14 is in the form of a sheet metal strip, with the first contact 12 having a long extension forming the beam 18, and the second contact 14 having a short extension forming a second contact part 17. Each of the contacts has a portion that extends through the lower housing part 16 which is formed of insulating material. The beam 18 is formed so that it is spring biased upwardly against the second contact part 17.

The upper housing part 20 may be formed of metal, but is preferably formed of a polymer plated with an electrically conductive coating. The entrance 24 preferably has electrically conductive conical side walls 25, which taper downwardly and inwardly towards the beam 18. The opening is formed in an electrically insulative barrier 90, that is part of an upper wall 30 of a cavity 119. The opening 26 leads downwardly to the cavity 119, with a beam 18 of the first contact and parts 17 of the second contact both lying in the cavity. The cavity has a width that is a plurality of times greater than the width of the opening 26. The opening 26 is of larger diameter than the portion of the projection 19 that passes through it, to assure unobstructed vertical movement of the projection 19 despite slight misalignment. However, the gap between the projection 19 and the walls of the opening 26 is small to almost seal the opening so as to restrict the passage of dirt into the interior of the housing. Also, the beam preferably lies close to the bottom of the barrier to help keep out dirt.

The coaxial connector plug 100 includes an insulator 104 that lies between the concentric inner and outer contact elements 102, 106. The lower or front end 108 of the plug is dome shaped, without the end 120 of the inner element having to protrude considerably beyond the front end of the insulator and outer contact element. This reduces the likelihood of the terminals being damaged in normal use. The engagement of the largely dome or spherically-shaped end 108 of the outer contact element 106 with the tapered conductive side walls 25 that form the entrance, can be achieved despite misalignment of the axis 110 of the plug with the axis 122 of the entrance. The maximum angle of misalignment A is about 15° for the particular switch and plug illustrated.

Figure 3A:
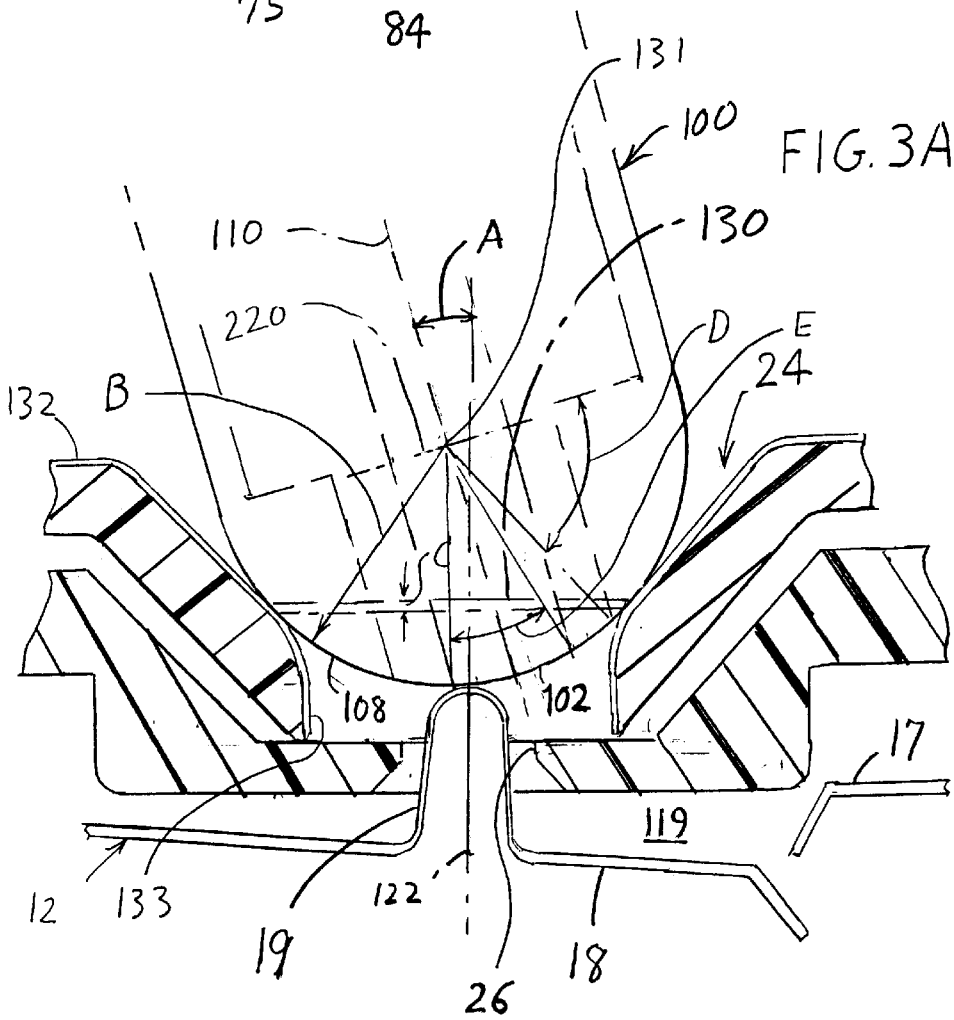
FIG. 3A is a partial sectional view of the switch assembly of FIG. 2, with the plug fully mated to the switch, and with the projection being devoid of a lower end.

FIG. 3A shows the plug 100 fully inserted into the entrance 24 and depressing the projection 19 so the beam 18 of the first contact is depressed out of engagement with the contact part 17 of the second contact. The largely spherical shape of the outer contact lower end 108 results in engagement along a largely circular or oval ring of engagement 130, for low resistance engagement. The relatively large radius of curvature B of the outer contact element end about a sphere center 131 which is substantially equal to the outside diameter of the plug mating end, results in a ring of substantial width C for large area contact when at least moderate downward force is applied to the plug. The diameter of the plug which equals two times B at the cylindrical portion of its outer end is greater than the diameter of the bottom 133 of the entrance. It would be possible for the area of the entrance 24 to be spherical and match the curvature of the plug, for a greater area of contact.

The spherical part of the outer element mating ends is shown as a band extending along an angle D of about 65°. The inner element forms an included angle E of about 30°, which enables a maximum misalignment angle A of 15°. The area of the opening 26 is less than half the area within the entrance bottom 133 that is spanned by the barrier.

Selected portions of the housing are plated with a conductive coating 132. The coating 132 preferably extends down to the bottom of the housing at 17 in FIG. 2, to connect to the grounding trace 116 on the circuit board.

A primary use for the switch assembly of the invention is to pass radio frequency signals between a docking station that is used with a mobile telephone, to transmit such signals selectively between an antenna on the station or on the mobile telephone. In one case, the switch lies in the telephone and the first contact 12 (FIG. 2) is initially coupled by the circuit board to transmitting and receiving circuitry on the telephone, with the second contact 14 coupled to an internal antenna of the mobile telephone, through the switch. Upon introduction of the connector plug 100, which lies on the docking station, the internal antenna in the telephone is disconnected from the receiving and transmitting circuitry, and instead an external antenna in the mobile telephone is connected to such circuitry.

The projection 14 may be formed in many ways. For example, it may be formed by deep-drawing part of the material of the beam, as in FIG. 3A. Alternatively, the projection 19 may be a separately-formed component that is fixed to the beam, as by projecting it through a hole in the beam and welding it in place.

Figure 4:
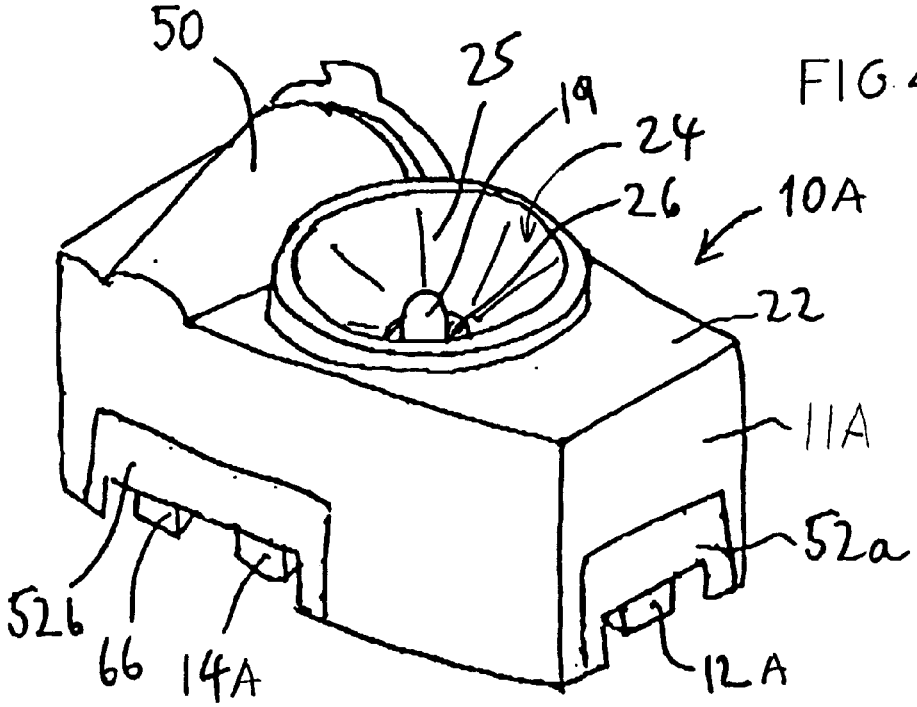
FIG. 4 is a top isometric view of a switch of a second embodiment of the invention.

FIG. 3 shows some details of the insulative lower housing part 16, with the beam 18 and second contact part 17 in engagement. The beam 18 preferably has an enlarged area 136 that lies closely under the bottom of the barrier 90 to provide somewhat better sealing against the barrier prior to downward deflection of the beam. FIGS. 4 and 5 illustrate another switch assembly 10A which also include first and second contacts 12A, 14A which are connected together through a beam having a projection 19 extending through an opening 26 in an entrance 24 with electrically conductive side walls 25. The switch 10A has a port 50 (FIG. 5) for receiving another plug. FIG. 4 shows that the connector includes a unitary plastic body or housing 11A which is plated on almost its entire outside, with areas 52*a*, 52*b*, which surround the contacts 12A, 14A and contact 66, not being plated. The plating is preferably connected to a ground trace on the circuit board, so the plating and the housing acts as an electromagnetic shield to provide protection against cross-talk interference. The housing includes a single molded polymer housing part with selected plating.

As shown in FIG. 5, only selected areas of the housing are plated. The plated areas include areas 140*a*, 140*b*as well as contacts 12A, 14A, and 66. The entire housing is formed of plastic that is plated in selected areas, with the plating forming the contacts 12A, 14A, and 66, and also forming the contact part 17A that is engaged by the resilient beam 18A. The only component that is inserted into the largely plated housing is the beam 18A which has one end fixed to the plating at 12A. Selective plating is well known in the art, as by selective etching of a continuous coating or by depositing a masking coating to allow plating of only unmasked areas.

FIGS. 4 and 5 show a port 50 for connection to an internal antenna in a telephone, as by receiving a conventional connector plug. As shown in FIG. 5, the port has an outer port contact 60 for connection to the outer conducting part of a coaxial line and an inner contact part 64 lying inside the switch housing for contact with the inner conductor of the coaxial line. The contact 60 comprises an annular metal ring mounted in grooves 62 in the housing. The inner contact part is resiliently compressible.

In FIG. 5, one contact, which may lead to transmitting and receiving circuitry in a mobile telephone, connects to an internal antenna in the telephone. The internal antenna signal is provided to the port 50. The internal antenna may be connected to the receiving and transmitting circuitry by providing a conductive trace on the circuit board that connects the contact 15 to the contact 66. In some situations, additional circuitry lies between the contacts 14A and 66. An external antenna can be utilized by a coaxial connector similar to that shown at 100 in FIG. 2 to break contact between the beam 18A of FIG. 5 and the second contact part 17A.

Figure 6:
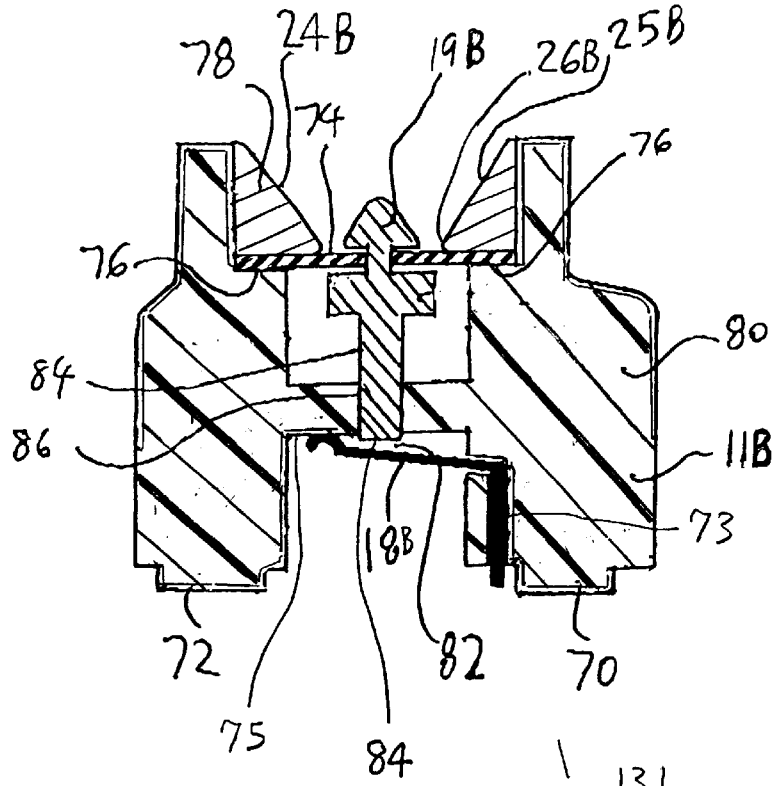
FIG. 6 is a sectional view of a switch of a third embodiment of the invention.

FIG. 6 shows a third embodiment of the invention, with a modified projection 19B and a modified barrier 74 which is elastomeric. The switch of FIG. 6 includes a housing 11B which may comprise a plastic body selectively plated with an electrically conductive plating. In FIG. 6, plated regions 70, 72 form first and second contacts that are each soldered to corresponding circuit board traces. The housing forms an interference fit at a recess 73 for the beam 18B, so one end of the beam makes contact with the plated area at 70. The beam is resiliently biased up against a contact region 75 which is plated. In this embodiment of the invention, the projection 19B is not mounted on the beam, but only lies over it. The projection 19B is supported by an elastomeric barrier 74 that extends across the opening 26B. The elastomeric barrier 74, which can be of rubber, is clamped between shoulders 76 on the housing and a press-fit retaining member 78 that is press fit into a cylindrical opening at the top of the housing. The retaining member 78 can be formed of plastic with a conductive coating, or may be formed entirely of conductive material such as metal to form the conductive tapered entrance walls 25B. The outer conductive surface of the retaining member 78 lies in a press fit against an electrically conductive coating portion on the housing, with a portion of the plating preferably extending to the bottom of the housing and soldered to a grounding trace on the circuit board.

The resiliency of the barrier 74 urges it to a flat position as shown in FIG. 6. The projection 19B is spaced from the beam by a gap shown at 82. When no coaxial connector plug is inserted into the entrance 24B, the projection 19B is not in electrical contact with the beam 18, and therefore is an electrically unconnected part. This reduces electromagnetic interference between the switch and traces on the circuit board.

When the coaxial connector such as 100 of FIG. 2 is inserted into the entrance 24B, the projection 19B moves down against bias of the barrier 74 and its lower end 84 downwardly deflects the beam 18 out of engagement with the second contact 72. Electrical engagement with the center contact element of the plug connector with the beam 18B and first contact 70, is made through the electrically conductive projection 19B. The projection 19B is guided in vertical sliding by a bore 86 formed in the housing. In addition to the barrier 74 biasing the projection upwardly out of engagement with the beam 18, the barrier 74 acts as a seal between the outside and inside of the switch. It is noted that where desired, the bottom of the projection can initially lie against the beam 18B to maintain contact with it, although this is difficult to achieve in a small switch.

FIG. 7 shows a prime application of the present coaxial switch assembly, for connecting a mobile telephone 200 to a docking station 210 that serves as a cradle for the mobile phone. When the mobile phone 200 is detached from the cradle 210, the switch 10 connects an internal antenna 204 of the telephone to receiving and transmitting circuitry in the telephone. When the telephone is docked to the cradle 210, the receiving and transmitting circuitry in the telephone is connected through the coaxial connector plug 100 to a substitute external antenna mounted on the docking station. Of course, additional connections may be provided for charging the battery of the mobile phone or for transmitting other information to and from the mobile phone.

While terms such as "upper", "lower", etc. have been used to help explain the invention as it is illustrated, it should be understood that the switch assembly can be used in any orientation with respect to the Earth.

Thus, the invention provides a switch assembly for mounting on a circuit board, with a switch that has an entrance for receiving a connecter plug, which enables the use of a damage-resistant connector plug. The switch includes a pair of contacts, with a first contact including a beam biased upwardly against a second contact. A projection mounted on the beam, projects upwardly at least partially through an opening that leads upwardly to the entrance. This enables the plug to depress the beam and open the switch, and also possibly electrically connects the plug to the beam through the projection, without requiring the plug to have a long slender projection to fit down through the opening to deflect the beam. The entrance is preferably tapered, as by making it conical, to guide the plug into place. For a coaxial system, the walls of the tapered entrance are of conductive material and preferably connected to a trace on the circuit board. At the mating end of the coaxial connector plug, the outer coaxial contact element is largely spherical, in that it is smoothly rounded about two axis of curvature (110 and 220 in FIG. 3A), so the outer contact element can engage the walls of the entrance along a circular band 130 for low resistance connection. The upward projection that projects at least partially upward through the opening and which is preferably electrically conductive, can be mounted on the beam, or can be separately mounted to move up and down and may lie out of direct contact with the beam until the projection is depressed. The entire housing can be formed of a one-piece plastic molded member which is selectively plated, with the only moving part being the beam.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A switch assembly for use with a connector plug, comprising:

a housing forming a cavity said housing having an entrance for receiving said connector plug, with said entrance leading downwardly to an opening and with said opening leading downwardly to said cavity, with said cavity having a cavity width and said opening having an opening width, with said cavity width being greater than said opening width;

first and second contacts mounted on said housing;

said first contact includes a resilient electrically conductive beam extending to said second contact, said beam being resiliently deflectable downwardly out of engagement with a part of said second contact but being biased toward engagement with said part of said second contact, said beam and said second contact part both lying in said cavity;

said beam has a beam location lying under said opening, and including a projection lying over said beam location and projecting generally upwardly into said opening, said projection being generally downwardly depressable to deflect said beam out of engagement with said second contact part.

2. The switch assembly described in claim 1 wherein:

said beam is formed of sheet metal of predetermined thickness, and said projection is part of said beam and extends upward by a distance that is a plurality of times the thickness of said sheet metal.

3. The switch assembly described in claim 1 wherein:

said projection is a member that is separate from said beam and that has a lower end that lies on said beam and that is vertically slideable in said opening.

4. The switch assembly described in claim 1 wherein:

said housing has electrically conductive entrance walls forming said entrance.

5. The switch assembly described in claim 1 wherein:

said housing is formed of a single molded polymer piece, with selected areas of said housing being metal plated to form parts of said first and second contacts, and with a majority of an outer surface of said housing being metal plated including walls of said entrance.

6. The switch assembly described in claim 1 including:

a resiliently depressable barrier that extends across a bottom of said entrance and that forms said opening;

said projection is mounted on said barrier with said barrier at said opening allowing said projection to move up and down, with said projection having a lower end lying over said beam.

7. The switch assembly described in claim 6 wherein:

said barrier holds said projection out of contact with said beam until said projection is pushed down.

8. The switch assembly described in claim 1 including:

a coaxial connector plug that includes coaxial inner and outer contact elements and an insulator lying between said elements, with said inner contact element having an end constructed to depress said projection and said outer contact element having an end that is exposed and of a diameter to engage said entrance walls while said inner contact element end depresses said projection to deflect said beam out of engagement with said second contact element, with said entrance walls being tapered;

said end of said outer element is of largely spherical shape.

9. The switch assembly described in claim 7 wherein:

said tapered entrance walls converge in a downward direction to form said entrance as a tapered entrance;

said end of said outer contact element has a diameter chosen so when said end of said outer contact element is moved fully downward into said entrance with the walls of said entrance preventing any further downward movement, said inner contact has deflected said beam out of engagement with said second contact element.

10. A switch assembly comprising:

a circuit board with an upper face and a plurality of conductive traces on said upper face;

a housing having a lower end for lying on said circuit board, said housing forming a cavity and said housing having an upper end with tapered electrically conductive entrance walls lyinq above said cavity and forming a tapered entrance with an entrance axis and with a lower end lying above said cavity, and including walls forming an opening at the lower end of said entrance said opening leading to said cavity with said cavity having a width and said opening having a width that is less than said cavity width, said entrance walls connected to one of said traces, said tapered entrance walls extending downwardly and toward said entrance axis;

first and second contacts mounted on said housing, said second contact having a part lying in said cavity and said first contact including a resilient beam which lies in said cavity and which is biased up against said first contact part but which can be resiliently deflected downward out of engagement with said first contact part;

projection means lying over said beam and projecting up at least partially through said opening, for depressing said beam out of engagement with said first contact when said projection means is depressed.

11. The switch described in claim 10 including:

a coaxial connector plug with a plug axis and with inner and outer contact elements centered on said axis and having front ends and an insulator between said contact elements, said connector plug being constructed so when said outer element is pushed to a fully inserted position in said entrance, the front end of said inner contact element engages said projection means and depresses it out of engagement with said first contact;

said outer element front end being of substantially spherical shape, to enable a ring-shaped line of contact between said outer element front end and said conductive entrance walls despite misalignment of said plug axis with said entrance axis.

12. A switch assembly comprising:

a housing forming a cavity, said housing having an upper end with electrically conductive walls forming a tapered entrance with an entrance bottom lying above said cavity, and including walls forming an opening at said entrance bottom which leads downwardly to said cavity, with said cavity having a width and said opening having a width that is smaller than said cavity width, said entrance having an entrance axis and said entrance being tapered so it has a progressively smaller diameter at lower locations along said axis;

first and second contacts mounted in said housing, said first contact including a resilient beam which lies in said cavity and which is biased against said second contact but that can be resiliently deflected downward out of engagement with said first contact;

a coaxial connector plug with a plug axis, inner and outer contact elements that are coaxial with said plug axis and that have mating ends, with the mating end of said outer element constructed to engage said tapered entrance when said connector plug is pushed to a fully inserted position into said entrance, and said inner element is constructed to electrically connect to said beam and depress said beam out of engagement with said second contact when said connector plug reaches said fully inserted position;

said outer contact of said coaxial connector plug having a lower end that is of substantially spherical shape, to engage radially opposite sides of said tapered entrance in said fully inserted position despite misalignment of said coax connector axis with said entrance axis.

13. The switch assembly described in claim 12 wherein:

said beam has an electrically conductive upward projection that extends at least partially through said opening.

14. The switch assembly described in claim 13 wherein:

said projection projects above said opening into said entrance.

15. A coaxial connector plug comprising:

inner and outer coaxial contact elements lying coaxial on a plug axis and an insulator lying between said contact elements, said contact elements having exposed mating ends, with the mating end of said outer contact having a predetermined maximum diameter (2B) and lying on the surface of an imaginary sphere that has a sphere center lying on said plug axis and that has a radius (B) that is half of said maximum diameter (2B), said mating ends of said inner and outer contact elements both lie substantially on said imaginary sphere.

16. A coaxial switch which includes a housing forming a cavity with a cavity top wall having an opening, said cavity having a width and said opening having a width that is smaller than the width of said cavity, first and second contacts each having a part lying in said cavity, with said first contact part being resiliently downwardly deflectable, including:

projection which is vertically slideable in said opening, and that has an upper projection part lying above said opening and being depressable, and that has a lower projection end lying below said opening and positioned to depress said first contact part when said upper projection part is depressed.

17. The switch described in claim 16 wherein:

said housing forms an entrance lying above and in line with said opening, said entrance having electrically conductive entrance walls that converge in a downward direction.

18. A combination of a coaxial connector plug and a switch, wherein:

said coaxial connector plug includes inner and outer contact elements lying coaxial on a plug axis and an insulator lying between said contact elements, said contact elements having exposed mating ends, with the mating end of said outer contact element being substantially spherical;

said switch includes a switch housing with a tapered upwardly-opening entrance having an entrance bottom with an opening thereat and with said entrance having conductive entrance walls forengaging said outer coaxial contact;

said switch also includes first and second contacts mounted on said housing with said first contact having a resilient beam biased against said second contact and deflectable out of engagement therewith, and with a projection lying at said opening and being mechanically and electrically coupled to said beam at least when said projection is depressed, with said inner contact element constructed to engage and depress said projection.

* * * * *